US008521053B2

(12) United States Patent
Iijima et al.

(10) Patent No.: US 8,521,053 B2
(45) Date of Patent: Aug. 27, 2013

(54) COOLING DEVICE AND IMAGE FORMING APPARATUS

(75) Inventors: Yasuaki Iijima, Kanagawa (JP); Kenichi Takehara, Kanagawa (JP); Hiromitsu Fujiya, Kanagawa (JP); Takayuki Nishimura, Tokyo (JP); Satoshi Okano, Kanagawa (JP); Tomoyasu Hirasawa, Kanagawa (JP); Masanori Saitoh, Tokyo (JP); Shingo Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 305 days.

(21) Appl. No.: 12/870,190

(22) Filed: Aug. 27, 2010

(65) Prior Publication Data

US 2011/0052249 A1 Mar. 3, 2011

(30) Foreign Application Priority Data

Aug. 28, 2009 (JP) ..... 2009-198350

(51) Int. Cl.
*G03G 21/20* (2006.01)
*G03G 15/20* (2006.01)
*F28D 15/00* (2006.01)

(52) U.S. Cl.
USPC ..... 399/94; 399/341; 165/104.31

(58) Field of Classification Search
USPC ..... 399/94, 341; 165/104.31
See application file for complete search history.

(56) References Cited

U.S. PATENT DOCUMENTS

| | | | | |
|---|---|---|---|---|
| 6,501,500 | B1 * | 12/2002 | Olenio et al. | 347/263 |
| 2009/0269099 | A1 | 10/2009 | Takehara | |
| 2010/0129107 | A1 | 5/2010 | Takehara et al. | |

FOREIGN PATENT DOCUMENTS

| | | |
|---|---|---|
| JP | 10-207155 | 8/1998 |
| JP | 2006-3628 | 1/2006 |
| JP | 2006-58493 | 3/2006 |
| JP | 2009-265489 | 11/2009 |

OTHER PUBLICATIONS

U.S. Appl. No. 12/844,384, filed Jul. 27, 2010, Okano, et al.
U.S. Appl. No. 12/860,174, filed Aug. 20, 2010, Nishimura, et al.

* cited by examiner

*Primary Examiner* — Joseph S Wong
(74) *Attorney, Agent, or Firm* — Oblon, Spivak, McClelland, Maier & Neustadt, L.L.P.

(57) ABSTRACT

Disclosed is a cooling device that includes a cooling part that is movably provided between a first position and a second position different from the first position with respect to an image forming apparatus main body and cools a periphery thereof with a cooling medium to be supplied; a cooling medium supply part that is provided in the image forming apparatus main body and cools and supplies the cooling medium to the cooling part; and a connecting member that connects the cooling part to the cooling medium supply part to circulate the cooling medium between the cooling part and the cooling medium supply part; wherein the connecting member is configured to include a flexible member and spirally provided with a moving direction of the cooling part as an axis center.

7 Claims, 9 Drawing Sheets

COOLING DEVICE AND IMAGE FORMING APPARATUS

BACKGROUND OF THE INVENTION

1. Field of the Invention

The present invention relates to a cooling device having a cooling part movably provided with respect to an image forming apparatus main body, and an image forming apparatus having the cooling device.

2. Description of the Related Art

Some image forming apparatuses such as copiers, printers, facsimiles, or multi-function machines have a cooling device for cooling units provided around a unit such as a fixing unit that generates heat. For example, Patent Document 1 describes an image forming apparatus having a liquid-cooled cooling device that cools a process unit detachable from an image forming apparatus main body.

Further, for the purpose of achieving a high printing speed, an amount of heat applied to a sheet at image fixation has increased recently, which in turn easily causes the phenomenon so-called "blocking" in which softened toner is attached to another sheet and problems such as the curling of sheets. In order to prevent such problems, a sheet discharged from a fixing unit is cooled by a cooling unit. For example, Patent Document 2 describes an image forming apparatus having a heat pipe as a unit that cools sheets.

Generally, a fixing unit, a process unit, and the like are configured to be detachable from an image forming apparatus main body so that a maintenance operation and processing for addressing sheet jams can be performed. Further, since the fixing unit is at high temperature immediately after the stoppage of its operations, it is desired to perform the maintenance operation and the processing for addressing sheet jams after the fixing unit is cooled by the cooling unit. Similarly, since there is a likelihood that the process unit and the like would be heated by the fixing unit, it is better to perform the maintenance operation and the processing for addressing sheet jams after the process unit and the like are cooled.

However, in the case of the image forming apparatus described in Patent Document 1, when the process unit is detached from the image forming apparatus main body, a cooling pipe provided in the process unit is separated from a circulation pump provided in the image forming apparatus main body. In this situation, the process unit is not cooled. Therefore, at the time of performing the maintenance operation and the like, there is a high likelihood that the process unit would still be at high temperature, and thus an operator would be at risk when touching the process unit. Further, if cooling liquid remaining at a connection part (separation part) between the cooling pipe and the circulation pump were to fall into the image forming apparatus when the cooling pipe is separated from the circulation pump, subsequent image formation would be adversely affected. Moreover, if foreign matter such as toner and sheet powder scattered in the image forming apparatus were attached to the cooling liquid remaining at the connection part (separation part), the foreign matter would intrude into the cooling device to cause the degradation of the cooling liquid, a failure in the circulation pump, and the like.

On the other hand, if the circulation pump were integrated with the process unit, it could also be possible to circulate the cooling liquid even when the process unit is detached from the image forming apparatus main body. In this case, however, the process unit would need to be upsized, which in turn degrades the performance of the maintenance operation and the ability of addressing sheet jams. In addition, the upsizing of the process unit makes necessary improving the strength of a housing that supports the process unit, which in turn runs counter to the downsizing and the weight reduction of the process unit.

Further, the above problems could occur not only in the process unit but also in the fixing unit and other units required to be cooled.

Patent Document 1: JP-A-2006-3628

Patent Document 2: JP-A-10-207155

SUMMARY OF THE INVENTION

In light of the above circumstances, the present invention may provide a cooling device capable of maintaining the connection between a cooling part and a cooling medium supply part such as a circulation pump even when the cooling part such a cooling pipe is moved. Also, the present invention may provide an image forming apparatus having the cooling device.

According to an aspect of the present invention, there is provided a cooling device including a cooling part that is movably provided between a first position and a second position different from the first position with respect to an image forming apparatus main body and cools a periphery thereof with a cooling medium to be supplied; a cooling medium supply part that is provided in the image forming apparatus main body and cools and supplies the cooling medium to the cooling part; and a connecting member that connects the cooling part to the cooling medium supply part to circulate the cooling medium between the cooling part and the cooling medium supply part; wherein the connecting member is configured to include a flexible member and is spirally provided with a moving direction of the cooling part as an axis center.

According to another aspect of the present invention, there is provided a cooling device including a cooling part that is movably provided between a first position and a second position different from the first position with respect to an image forming apparatus main body and cools a periphery thereof with a cooling medium to be supplied; a cooling medium supply part that is provided in the image forming apparatus main body and cools and supplies the cooling medium to the cooling part; a connecting member that connects the cooling part to the cooling medium supply part to circulate the cooling medium between the cooling part and the cooling medium supply part, the connecting member being configured to include a flexible member; and a winding member capable of winding and unwinding the connecting member.

According to still another aspect of the present invention, there is provided a cooling device including a cooling part that is movably provided between a first position and a second position different from the first position with respect to an image forming apparatus main body and cools a periphery thereof with a cooling medium to be supplied; a cooling medium supply part that is provided in the image forming apparatus main body and cools and supplies the cooling medium to the cooling part; and a connecting member that connects the cooling part to the cooling medium supply part to circulate the cooling medium between the cooling part and the cooling medium supply part; wherein the connecting member is configured to include plural cylindrical members connected so as to be movable in a moving direction of the cooling part.

Other objects, features and advantages of the present invention will become more apparent from the following detailed description when read in conjunction with the accompanying drawings.

BRIEF DESCRIPTION OF THE DRAWINGS

FIGS. 5A and 5B are views showing the configuration of a cooling roller according to a first embodiment of the present invention, wherein FIG. 5A shows a state in which the cooling roller is accommodated, and FIG. 5B shows a state in which the cooling roller is extracted;

FIGS. 6A and 6B are views showing the configuration of the cooling roller according to a second embodiment of the present invention, wherein FIG. 6A shows a state in which the cooling roller is accommodated, and FIG. 6B shows a state in which the cooling roller is extracted;

FIGS. 7A and 7B are views showing the configuration of the cooling roller according to a third embodiment of the present invention, wherein FIG. 7A shows a state in which the cooling roller is accommodated, and FIG. 7B shows a state in which the cooling roller is extracted;

FIGS. 8A and 8B are views showing the configuration of the cooling roller according to a fourth embodiment of the present invention, wherein FIG. 8A shows a state in which the cooling roller is accommodated, and FIG. 8B shows a state in which the cooling roller is extracted;

FIGS. 9A and 9B are views showing the configuration of the cooling roller according to a fifth embodiment of the present invention, wherein FIG. 9A shows a state in which the cooling roller is accommodated, and FIG. 9B shows a state in which the cooling roller is extracted; and FIGS. 10A and 10B are views showing the configuration of the cooling roller according to a sixth embodiment of the present invention, wherein FIG. 10A shows a state in which the cooling roller is accommodated, and FIG. 10B shows a state in which the cooling roller is extracted.

DETAILED DESCRIPTION OF THE PREFERRED EMBODIMENTS

Figure 1:
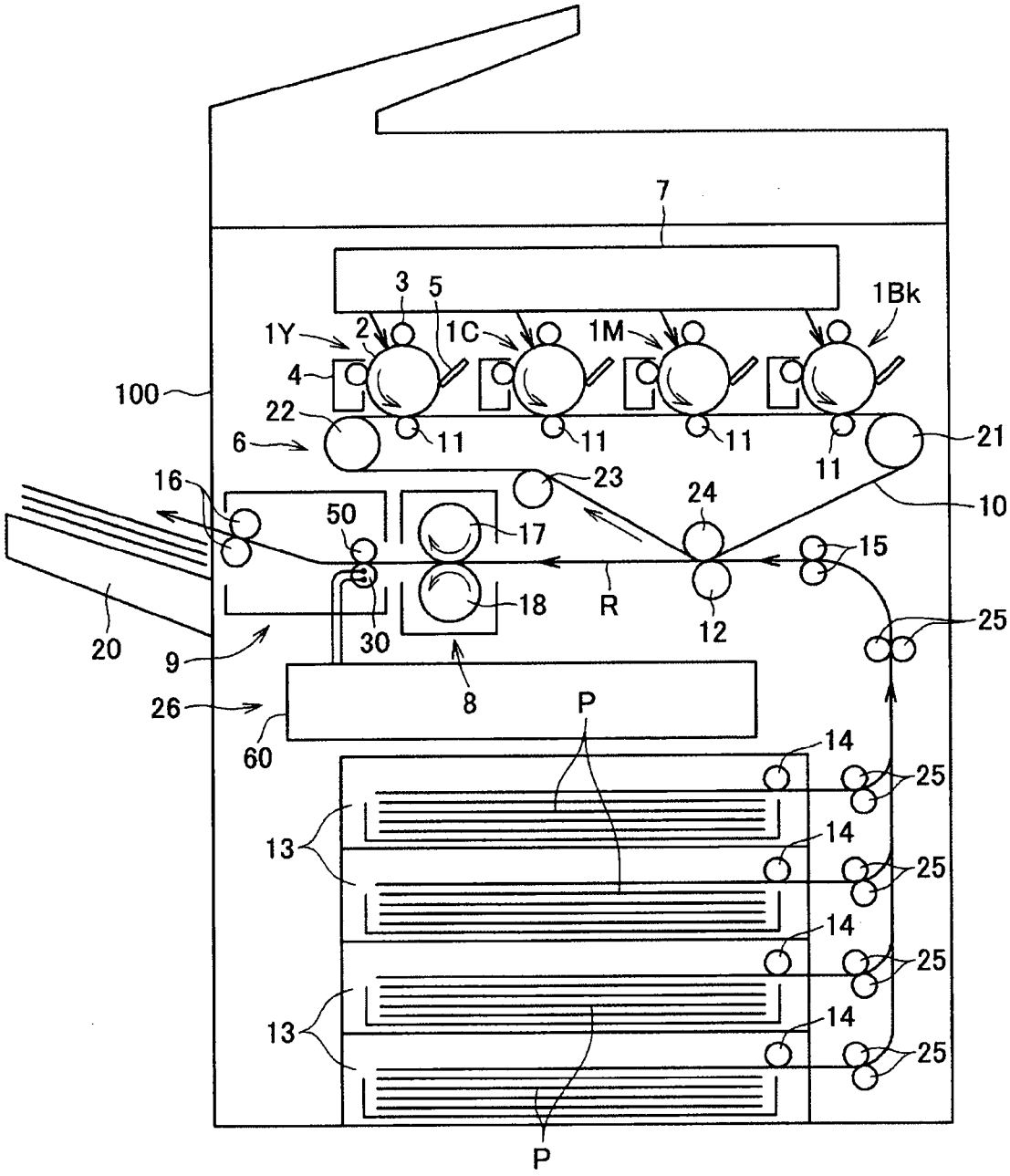
FIG. 1 is a schematic configuration diagram showing the entire configuration of an image forming apparatus according to embodiments of the present invention.

FIG. 1 is a schematic configuration diagram showing an image forming apparatus according to the embodiments of the present invention. The image forming apparatus shown in FIG. 1 has four process units 1Y, 1C, 1M, and 1Bk. The respective process units 1Y, 1C, 1M, and 1Bk are detachable from an image forming apparatus main body 100. The process units 1Y, 1C, 1M, and 1Bk are the same in configuration except that they accommodate different colors of toner, yellow, cyan, magenta, and black, respectively, corresponding to the color separation components of color images.

Specifically, the respective process units 1Y, 1C, 1M, and 1Bk have a photosensitive body 2 serving as an electrostatic latent image carrier, a charging roller 3 serving as a charging unit that charges the front surface of the photosensitive body 2, a development unit 4 that forms a toner image on the front surface of the photosensitive body 2, and a cleaning blade 5 serving as a cleaning unit that cleans the front surface of the photosensitive body 2.

In FIG. 1, an exposure unit 7 is provided above the process units 1Y, 1C, 1M, and 1Bk. The exposure unit 7 irradiates the photosensitive bodies 2 of the process units 1Y, 1C, 1M, and 1Bk with laser beams. Further, a transfer unit 6 is provided below the respective process units 1Y, 1C, 1M, and 1Bk. The transfer unit 6 has an intermediate transfer belt 10 formed of an endless belt bridged between plural rollers 21 through 24. The intermediate transfer belt 10 can circulate in the direction as indicated by an arrow in FIG. 1 when one of the plural rollers 21 through 24 rotates as a driving roller.

At positions opposing the four photosensitive bodies 2, four primary transfer rollers 11 serving as primary transfer units are provided. The primary transfer rollers 11 press the inner peripheral surface of the intermediate transfer belt 10 at the corresponding positions, and primary transfer nips are formed at places where the respective photosensitive bodies 2 contact the pressed parts of the intermediate transfer belt 10. Further, at a position opposing the roller 24 that stretches the intermediate transfer belt 10, a secondary transfer roller 12 serving as a secondary transfer unit is provided. The secondary transfer roller 12 presses the outer peripheral surface of the intermediate transfer belt 10, and a secondary transfer nip is formed at a place where the secondary transfer roller 12 contacts the intermediate transfer belt 10.

Below the image forming apparatus main body 100, plural sheet feeding cassettes 13 accommodating recording sheets P as recording media are provided. The respective sheet feeding cassettes 13 have sheet feeding rollers 14 for taking out the recording sheets P, and the like. Further, at an outer surface on the left side of the image forming apparatus main body 100 in FIG. 1, a sheet catching tray 20 that holds the recording sheets P ejected from the image forming apparatus main body is provided.

Inside the image forming apparatus main body 100, a conveyance path R is arranged for conveying the recording sheets P from the sheet feeding cassettes 13 to the sheet catching tray 20 through the secondary transfer nip. On the upstream side in the recording-sheet conveyance direction of the secondary transfer nip between the intermediate transfer belt 10 and the secondary transfer roller 12, a pair of resist rollers 15 are provided. Further, on the way from the sheet feeding cassettes 13 to the secondary transfer nip, plural pairs of conveyance rollers 25 are provided. On the downstream side in the recording-sheet conveyance direction of the secondary transfer nip, a fixing unit 8 and a sheet ejection unit 9 are successively arranged in this order. The fixing unit 8 has, for example, a heating roller 17 having a heating source inside it and a pressurizing roller 8 that presses the heating roller 17. The heating roller 17 and the pressurizing roller 18 are brought into press-contact with each other, thereby forming a fixing nip at a press-contact part between the heating roller 17 and the pressurizing roller 18. The sheet ejection unit 9 has a pair of sheet ejection rollers 16 opposing each other, and the like.

Further, the image forming apparatus according to the embodiments of the present invention has a cooling device 26 that cools the recording sheets P ejected from the fixing unit 8. The cooling device 26 has a cooling roller 30 and an opposing roller 50 opposing the cooling roller 30, a cooling medium supply unit 31 that cools or radiates a cooling medium and supplies the same to the cooling roller 30, and the like.

Referring next to FIG. 1, basic operations of the image forming apparatus are described.

The photosensitive bodies 2 of the respective process units 1Y, 1C, 1M, and 1Bk are driven to rotate in a counter-clockwise direction shown in FIG. 1, and the charging rollers 3 uniformly charge the front surfaces of the respective photosensitive bodies 2 to a predetermined polarity. Based on the image information of a document scanned by a scanning unit (not shown), the exposure unit 7 irradiates the charged front surfaces of the respective photosensitive bodies 2 with laser beams, thereby forming electrostatic latent images on the front surfaces of the respective photosensitive bodies 2. At this time, the image information items exposed on the respective photosensitive bodies 2 are single-color image information items of yellow, cyan, magenta, and black separated from a desired full-color image. The respective development units 4 supply toner to the electrostatic latent images thus formed on the photosensitive bodies 2. As a result, the electrostatic latent images are visualized as toner images.

One of the rollers stretching the intermediate transfer belt 10 is driven to rotate, so that the intermediate transfer belt 10 circulates in the direction as indicated by the arrow in FIG. 1. Further, either constant voltage having a polarity opposite to the charging polarity of the toner or voltage subjected to constant current control is applied to the respective primary transfer rollers 11, thereby forming transfer electric fields at primary transfer nips between the primary transfer rollers 11 and the respective photosensitive bodies 2. Then, the toner images of the colors formed on the respective photosensitive bodies 2 are successively transferred to the intermediate transfer belt 10 in a superposed manner by the transfer electric fields formed by the primary transfer nips. Thus, the intermediate transfer belt 10 has the full-color toner image carried on its front surface. Further, at the front surfaces of the respective photosensitive bodies 2 after the transfer of the toner images, toner that cannot be transferred to the intermediate transfer belt 10 remains. The cleaning blades 5 eliminate the toner remaining at the front surfaces of the photosensitive bodies 2.

Further, when the sheet feeding roller 14 rotates, the recording sheet P is taken out from the sheet feeding cassette 13. The taken-out recording sheet P is conveyed by the pair of plural conveyance rollers 25, and then fed to the secondary transfer nip between the secondary transfer roller 12 and the intermediate transfer belt 10 by a pair of resist rollers 15 with appropriate timing. At this time, transfer voltage having a polarity opposite to the toner charging polarity of the toner images on the intermediate transfer belt 10 is applied to the secondary transfer roller 12, thereby forming a transfer electric field at the secondary transfer nip. Then, the toner images on the intermediate transfer belt 10 are collectively transferred to the recording sheet P by the transfer electric field formed at the secondary transfer nip.

The recording sheet P to which the toner images are transferred is conveyed to the fixing unit 8. The recording sheet P fed to the fixing unit P is heated and pressed at a place between the heating roller 17 and the pressurizing roller 18, so that the toner images are fixed to the recording sheet P. Then, the recording sheet P passes through a part between the cooling roller 30 and the opposing roller 50. At this time, the recording sheet P is cooled through contact with the cooling roller 30. Then, the recording sheet P is ejected to the sheet catching tray 20 by the pair of sheet ejection rollers 16. Thus, the image forming apparatus cools the recording sheet P and then ejects the same to the sheet catching tray 20, thereby preventing problems such as the curling of the recording sheet P and the blocking.

The above description refers to an image forming operation for forming a full-color image on the recording sheet P. However, it is also possible to form a single-color image using any one of the four process units 1Y, 1C, 1M, and 1Bk, or form a two-color or three-color image using two or three of the process units.

Figure 2:
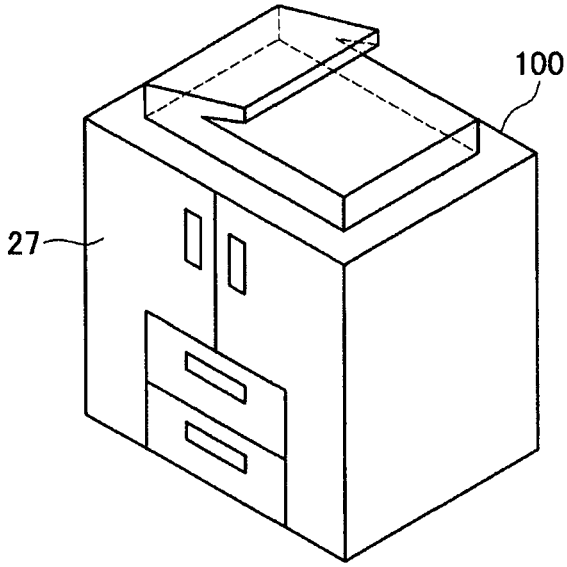
FIG. 2 is an external view of the image forming apparatus with an openable and closable door closed.
Figure 3:
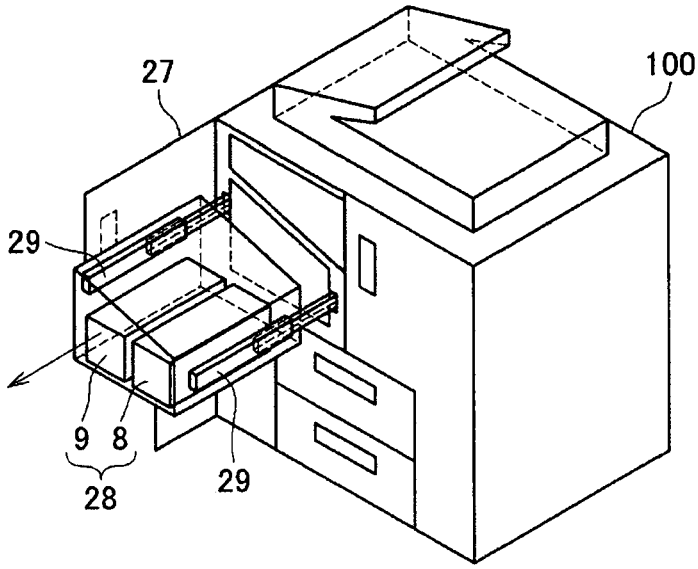
FIG. 3 is an external view of the image forming apparatus with the openable and closable door opened.

FIGS. 2 and 3 are external views of the image forming apparatus according to the embodiments.

As shown in FIG. 2, the external surface of the image forming apparatus main body 100 is provided with an openable and closable door 27. FIG. 3 shows a state in which the openable and closable door 27 is open. With the openable and closable door 27 opened, the fixing unit 8 and the sheet ejection unit 9 can be extracted from an opened space as an integrated extraction unit 28. The extraction of the fixing unit 8 and the sheet ejection unit 9 from the image forming apparatus main body 100 facilitates a maintenance operation and processing for addressing sheet jams. Note that in the embodiments, the extraction unit 28 is supported on a pair of guide rails 29 provided in the image forming apparatus main body 100, and the guide rails 29 extend and retract in a sliding manner to enable the extraction and accommodation of the extraction unit 28. However, it is also possible to use other extraction mechanisms.

Figure 4:
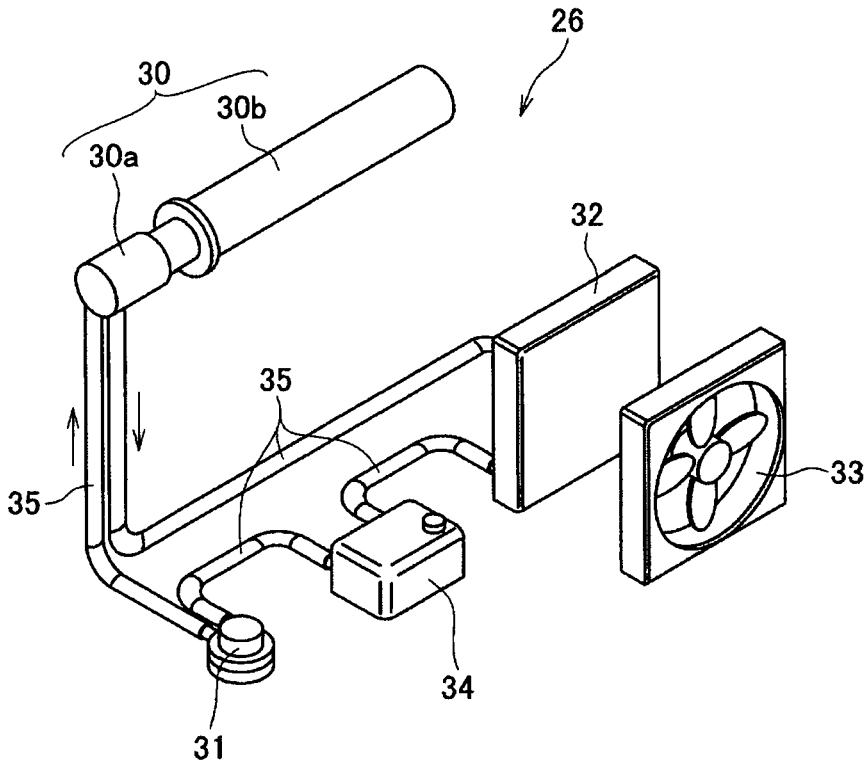
FIG. 4 is a view showing the basic configuration of a cooling device according to the embodiments of the present invention.

FIG. 4 is a view showing the basic configuration of the cooling device 26.

As shown in FIG. 4, the cooling device 26 has a cooling roller 30 serving as a cooling unit that cools a body to be cooled; an opposing roller 50 (not shown) opposing the cooling roller 30; a pump 31 serving as a cooling medium supply unit that cools or radiates a cooling medium and supplies the same to the cooling roller 30; a radiator 32; a fan 33; a tank 34 that stores the cooling medium; and circulation paths 35 in which the cooling medium circulates. The cooling roller 30, the pump 31, the radiator 32, and the tank 34 are connected to one another by the circulation paths 35.

The cooling roller 30 has a non-rotating supporting part 30*a* and a rotating part 30*b* rotatably supported to the supporting part 30*a*. The non-rotating supporting part 30*a* is connected to the circulation paths 35, and the cooling medium circulates through a cooling medium path (not shown) provided in the supporting part 30*a* and the rotating part 30*b* through the connected circulation paths 35. Further, the rotating part 30*b* is formed to be longer than the supporting part 30*a*, and the recording sheet P is cooled through contact with the rotating part 30*b* which is being rotated. The cooling roller 30 is made of a material having good heat conductivity. In the embodiments, the cooling roller 30 is made of an aluminum material from the viewpoint of costs and manufacturing easiness. However, it is also possible to use copper and other materials having good heat conductivity.

The pump 31 is the cooling medium supply unit that supplies the cooling medium to the cooling roller 30 through the circulation paths 35. Here, as the cooling medium, cooling liquid is used which has water as a main component and to which propylene glycol or ethylene glycol for decreasing a freezing temperature and an antirust (e.g., phosphate substance such as calcium phosphate and inorganic calcium phosphate) for preventing rust in metal parts are added. Further, the cooling liquid circulates in the circulating paths 35 in the directions as indicated by arrows in FIG. 4. The radiator 32 is a radiating unit that accommodates the cooling liquid to cool the cooling liquid. The fan 33 sends air to the radiator 32 to enhance the heat radiating effect of the radiator 32. Further, in accordance with the heat radiating amount of the radiator 32, either forced-air cooling with the fan 33 or natural air cooling (i.e., air cooling without the fan 33) can be selected. The tank 34 is provided to store reserve cooling liquid.

As described above referring to FIGS. 2 and 3, the fixing unit 8 and the sheet ejection unit 9 can be extracted from the image forming apparatus main body 100. Here, since the cooling roller 30 and the opposing roller 50 opposing the cooling roller 30 are provided in the sheet ejection unit 9, they are extracted together with the sheet ejection unit 9. On the other hand, the pump 31, the radiator 32, the fan 33, the tank 34 are provided in the image forming apparatus main body 100. Thus, the cooling roller 30 can be moved with respect to the pump 31 and the like which are fixed. However, different from conventional image forming apparatuses, the embodiments of the present invention are so arranged that the cooling roller 30 is not separated from the pump 31 or the like even when the cooling roller 30 is extracted. Hereinafter, the characteristics of the present invention are described in detail.

(First Embodiment)

Figure 5A:
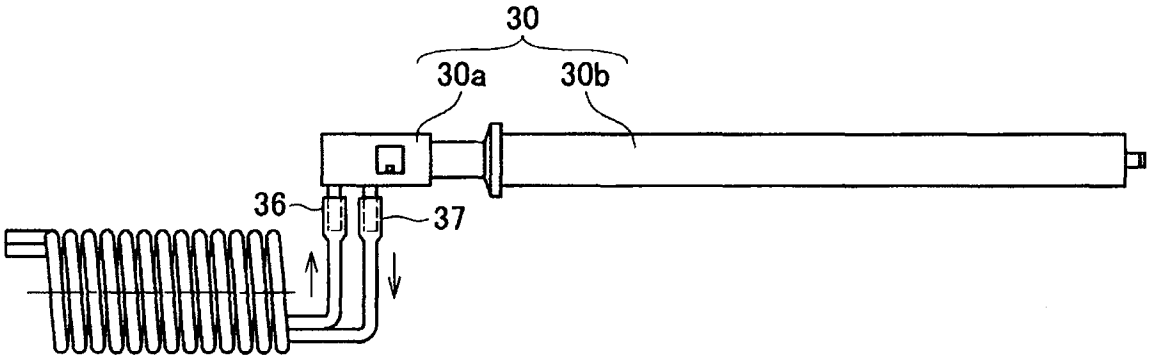
Figure 5B:
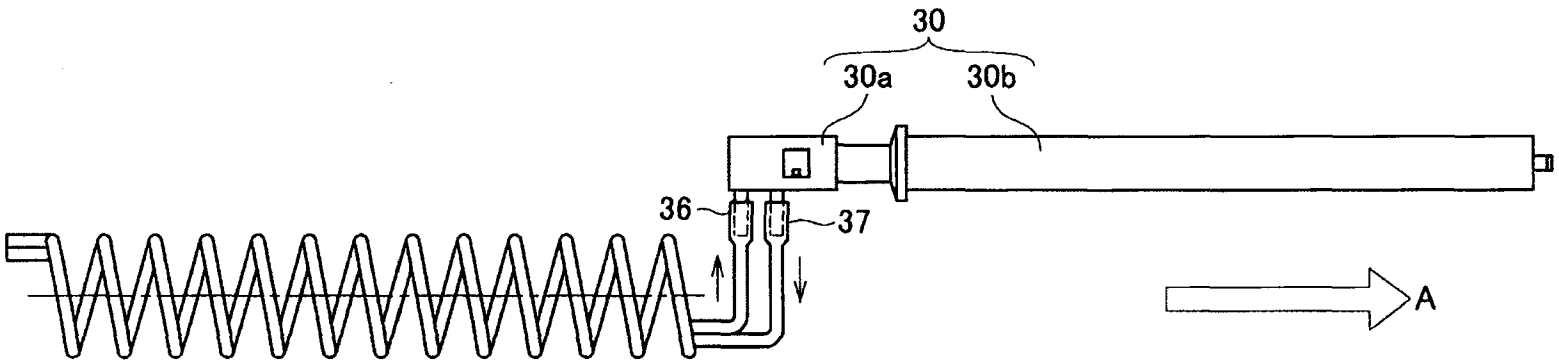

FIGS. 5A and 5B are views showing the configuration of the cooling roller 30 according to a first embodiment of the present invention. FIG. 5A shows a state in which the cooling roller 30 is accommodated in the image forming apparatus, and FIG. 5B shows a state in which the cooling roller 30 is extracted from the image forming apparatus.

As shown in FIGS. 5A and 5B, the supporting part 30*a* supporting the rotating part 30*b* is connected to a supply pipe 36 that supplies the cooling liquid to the cooling roller 30 and a discharge pipe 37 that discharges the cooling liquid from the cooling roller 30. The supply pipe 36 and the discharge pipe 37 are flow paths constituting parts of the circulation paths 35 shown in FIG. 4. Specifically, in FIGS. 5A and 5B, the supply pipe 36 is a connecting member that connects the cooling roller 30 to the pump 31, and the discharge pipe 3 is a connecting member that connects the cooling roller 30 to the radiator 32. The supply pipe 36 and the discharge pipe 37 are tubular members and configured to include flexible members such as rubber. Further, the supply pipe 36 and the discharge pipe 37 are spirally provided with the extracting direction A (moving direction) of the cooling roller 30 (or the extraction unit 28) as an axis center.

Thus, according to the first embodiment, the supply pipe 36 and the discharge pipe 37 are configured to include flexible members and spirally provided with the extracting direction A as an axis center. Therefore, when the cooling roller 30 is extracted, the supply pipe 36 and the discharge pipe 37 follow the cooling roller 30 with the pitch of the spiral expanded. Accordingly, the connection between the cooling roller 30 and the pump 31 and the like can be maintained even when the cooling roller 30 is extracted. On the other hand, when the cooling roller 30 is accommodated, the supply pipe 36 and the discharge pipe 37 follow the cooling roller 30 with the pitch of the spiral contracted. Therefore, the supply pipe 36 and the discharge pipe 37 can be compactly accommodated.

(Second Embodiment)

Figure 6A:
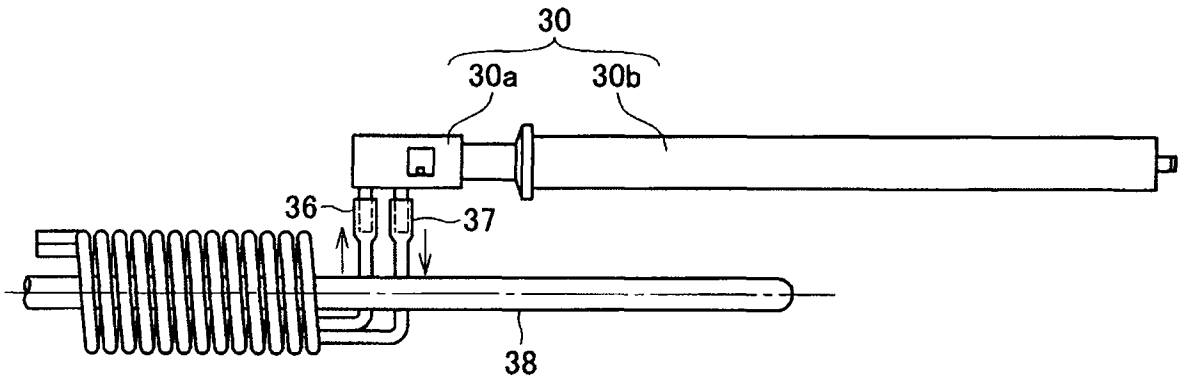
Figure 6B:
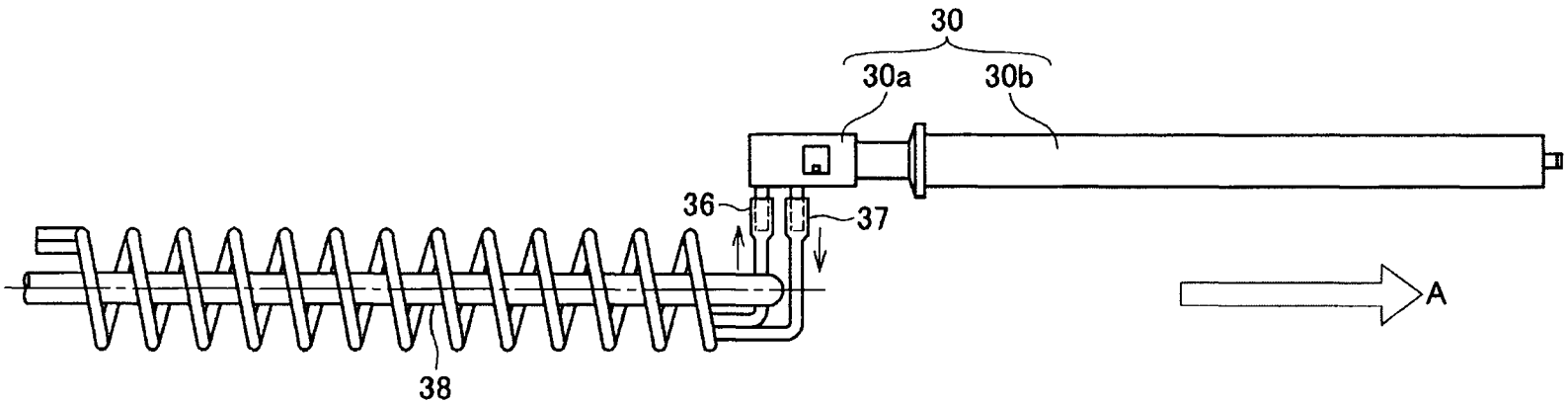

FIGS. 6A and 6B are views showing the configuration of the cooling roller 30 according to a second embodiment of the present invention. FIG. 6A shows a state in which the cooling roller 30 is accommodated in the image forming apparatus, and FIG. 6B shows a state in which the cooling roller 30 is extracted from the image forming apparatus.

According to the second embodiment shown in FIGS. 6A and 6B, similar to the first embodiment, the supply pipe 36 and the discharge pipe 37 connected to the cooling roller 30 are configured to include flexible members and spirally provided with the extracting direction (moving direction) A of the cooling roller 30 (or the extraction unit 28) as an axis center. Accordingly, similar to the first embodiment, the connection between the cooling roller 30 and the pump 31 and the like can be maintained even when the cooling roller 30 is extracted. In addition, when the cooling roller 30 is accommodated, the supply pipe 36 and the discharge pipe 37 can be compactly accommodated.

Moreover, according to the second embodiment, a rod-like guide member 38 extending in the extracting direction A (moving direction) is arranged inside the supply pipe 36 and the discharge pipe 37. The guide member 38 is attached to the image forming apparatus main body 100.

Thus, according to the second embodiment, when the supply pipe 36 and the discharge pipe 37 are expanded and contracted, they can be guided by the guide member 38. Therefore, the expanding and contracting operations of the supply pipe 36 and the discharge pipe 37 can be smoothly and stably performed, thereby making it possible to prevent the occurrence of buckling and folding in the supply pipe 36 and the discharge pipe 37.

Further, in FIGS. 6A and 6B, the guide member 38 is arranged inside the supply pipe 36 and the discharge pipe 37, but may be arranged outside the supply pipe 36 and the discharge pipe 37. Note that in FIGS. 6A and 6B, parts the same as those of FIGS. 5A and 5B are denoted by the same reference numerals and their descriptions are omitted.

(Third Embodiment)

Figure 7A:
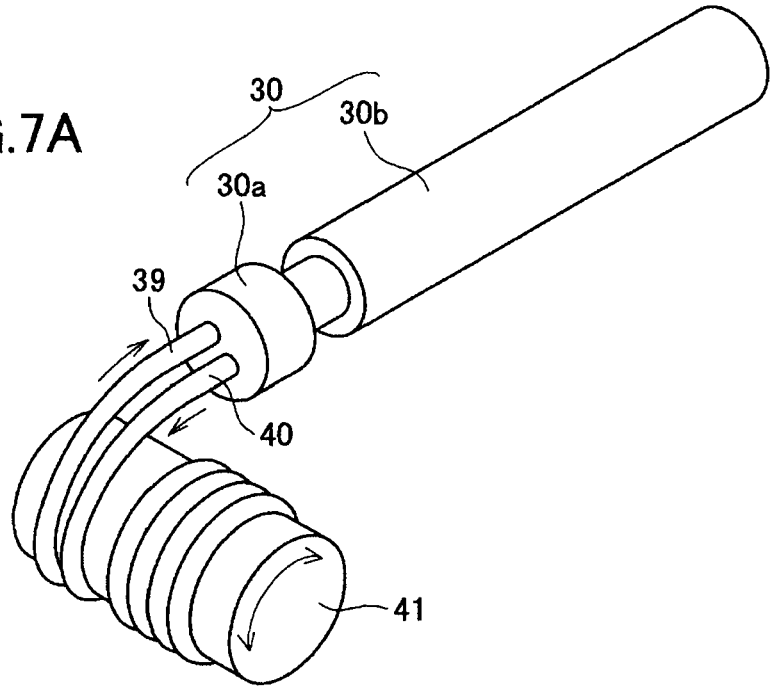
Figure 7B:
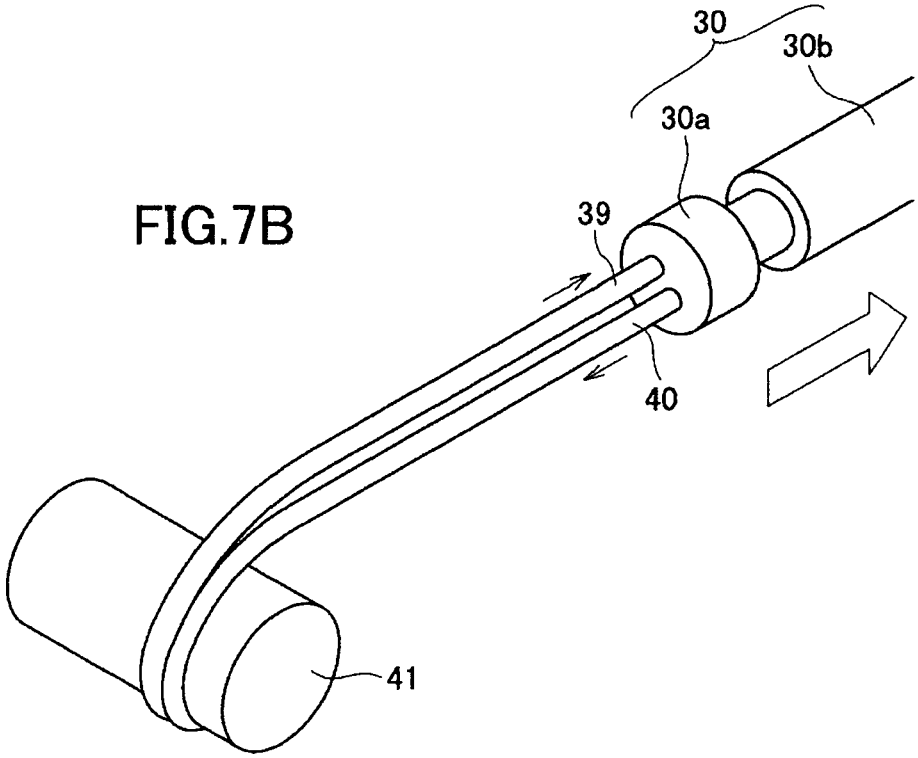

FIGS. 7A and 7B are views showing the configuration of the cooling roller 30 according to a third embodiment of the present invention. FIG. 7A shows a state in which the cooling roller 30 is accommodated in the image forming apparatus, and FIG. 7B shows a state in which the cooling roller 30 is extracted from the image forming apparatus.

As shown in FIGS. 7A and 7B, the supporting part 30*a* supporting the rotating part 30*b* is connected to a supply pipe 39 that supplies the cooling liquid to the cooling roller 30 and a discharge pipe 40 that discharges the cooling liquid from the cooling roller 30. Similar to the above embodiments, the supply pipe 39 and the discharge pipe 40 are flow paths constituting parts of the circulation paths 35 shown in FIGS. 4A and 4B. Specifically, in FIGS. 7A and 7B, the supply pipe 39 is a connecting member that connects the cooling roller 30 to the pump 31, and the discharge pipe 40 is a connecting member that connects the cooling roller 30 to the radiator 32.

According to the third embodiment, a winding member 41 capable of winding and unwinding the supply pipe 39 and the discharge pipe 40 is provided. Further, the supply pipe 39 and the discharge pipe 40 are configured to include flexible members such as rubber so that they are wound by the winding member 41. The winding member 41 is a drum-like member and rotatably attached to the image forming apparatus main body 100.

As shown in FIG. 7B, when the cooling roller 30 is extracted, the supply pipe 39 and the discharge pipe 40 can be unwound from the winding member 41. Therefore, the connection between the cooling roller 30 and the pump 31 and the like can be maintained even when the cooling roller 30 is extracted. On the other hand, as shown in FIG. 7A, when the cooling roller 30 is accommodated, the supply pipe 39 and the discharge pipe 40 can be wound by the winding member 41 and compactly accommodated.

(Fourth Embodiment)

Figure 8A:
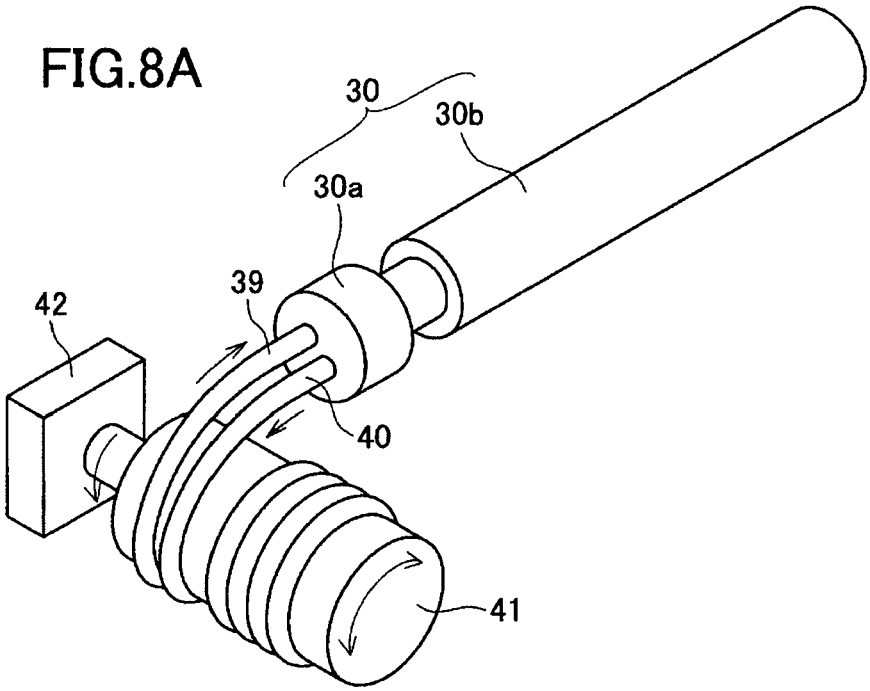
Figure 8B:
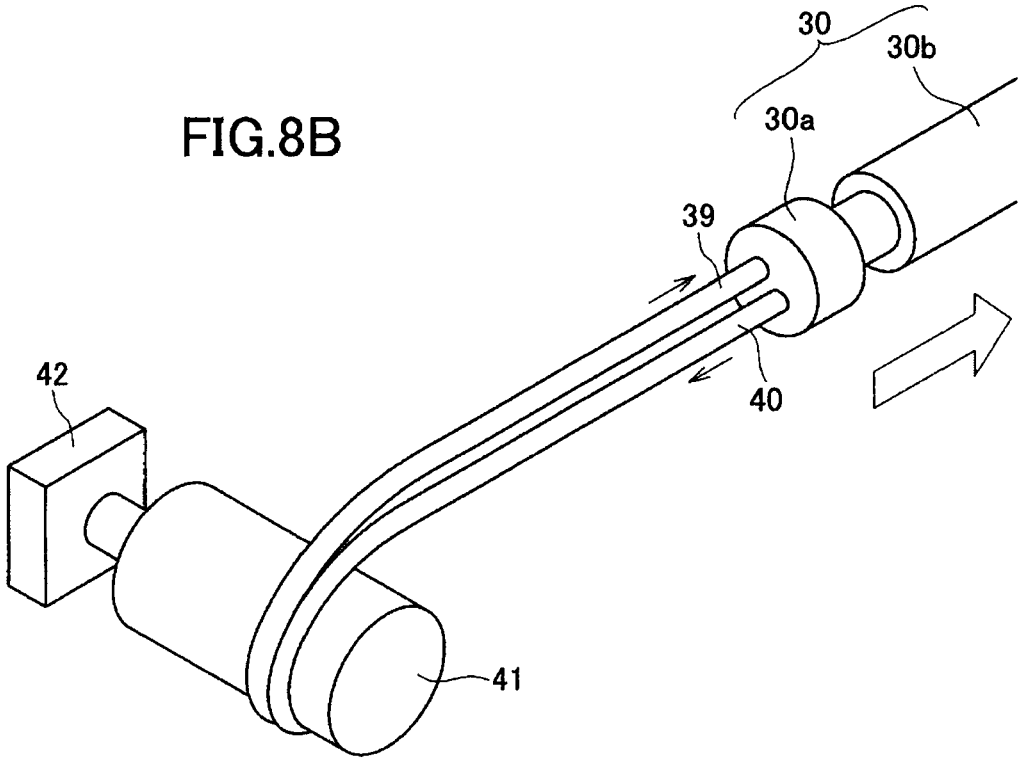

FIGS. 8A and 8B are views showing the configuration of the cooling roller 30 according to a fourth embodiment of the present invention. FIG. 8A shows a state in which the cooling roller 30 is accommodated in the image forming apparatus, and FIG. 8B shows a state in which the cooling roller 30 is extracted from the image forming apparatus.

According to the fourth embodiment shown in FIGS. 8A and 8B, similar to the third embodiment, the winding member 41 capable of winding and unwinding the supply pipe 39 and the discharge pipe 40 is provided. Accordingly, similar to the third embodiment, the connection between the cooling roller 30 and the pump 31 and the like can be maintained even when the cooling roller 30 is extracted. In addition, when the cooling roller 30 is accommodated, the supply pipe 39 and the discharge pipe 40 can be compactly accommodated.

Moreover, according to the fourth embodiment, a driving unit 42 that drives the winding member 41 to rotate is provided. The winding member 41 is driven by the driving unit 42 in the winding direction. The driving unit 42 can be one that rotates the winding member 41 in at least one direction of a motor spring or the like. Further, the driving unit 42 can be one that drives the winding member 41 in both the winding direction and the unwinding direction.

As described above, according to the fourth embodiment, the supply pipe 39 and the discharge pipe 40 can be automatically wound by the driving unit 42. Therefore, it is possible to easily and smoothly wind the supply pipe 39 and the discharge pipe 40. Note that in FIGS. 8A and 8B, parts the same as those of FIGS. 7A and 7B are denoted by the same reference numerals and their descriptions are omitted.

(Fifth Embodiment)

Figure 9A:
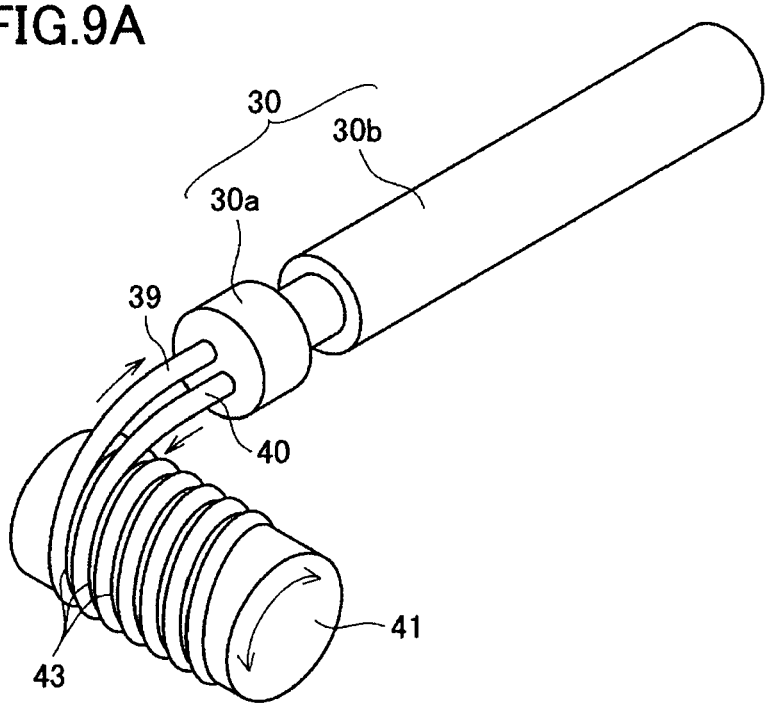
Figure 9B:
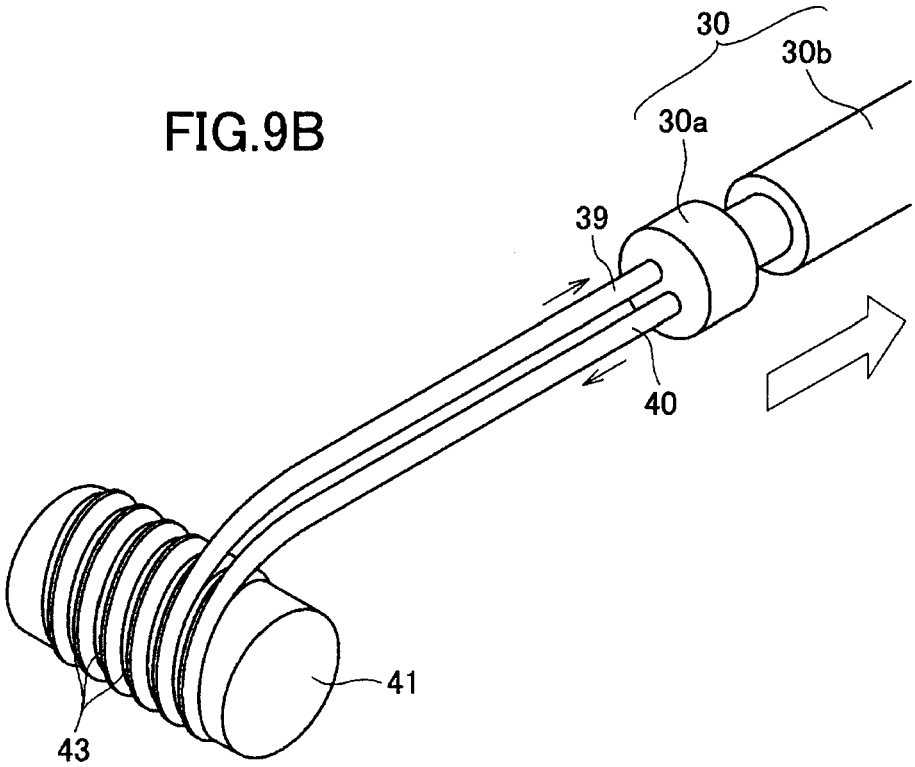

FIGS. 9A and 9B are views showing the configuration of the cooling roller 30 according to a fifth embodiment of the present invention. FIG. 9A shows a state in which the cooling roller 30 is accommodated in the image forming apparatus, and FIG. 9B is a state in which the cooling roller 30 is extracted from the image forming apparatus.

According to the fifth embodiment shown in FIGS. 9A and 9B, similar to the third embodiment, the winding member 41 capable of winding and unwinding the supply pipe 39 and the discharge pipe 40 is provided. Accordingly, similar to the third embodiment, the connection between the cooling roller 30 and the pump 31 and the like can be maintained even when the cooling roller 30 is extracted. In addition, when the cooling roller 30 is accommodated, the supply pipe 39 and the discharge pipe 40 can be compactly accommodated.

Moreover, according to the fifth embodiment, convex winding guide parts 43 are formed at the external peripheral surface of the winding member 41. The supply pipe 39 and the discharge pipe 40 are guided to predetermined winding positions between the winding guide parts 43 when being wound by the winding member 41. In this manner, the supply pipe 39 and the discharge pipe 40 can be wound in an aligned manner at the predetermined winding positions. Thus, the supply pipe 39 and the discharge pipe 40 can be compactly accommodated. In addition, the winding guide parts 43 can prevent the compression, folding, twisting, or the like of the supply pipe 39 and the discharge pipe 40 caused when the supply pipe 39 and the discharge pipe 40 are not properly wound. As a result, pressure changes inside the fluid paths are reduced, so that a high-efficiency cooling system can be realized. Note that in FIGS. 9A and 9B, parts the same as those of FIGS. 7A and 7B are denoted by the same reference numerals and their descriptions are omitted.

(Sixth Embodiment)

Figure 10A:
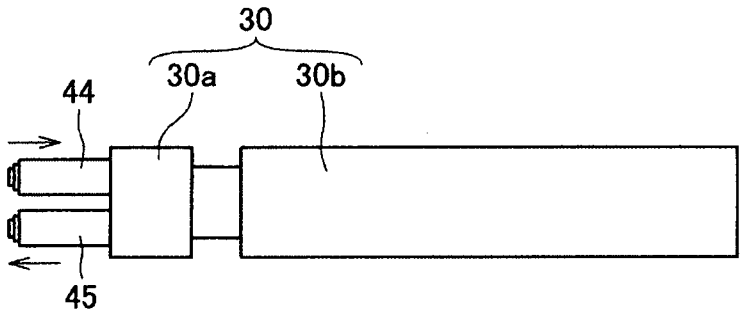
Figure 10B:
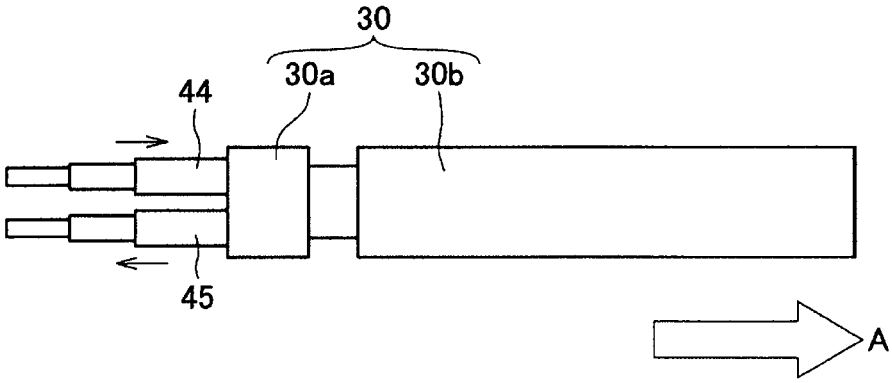

FIGS. 10A and 10B are views showing the configuration of the cooling roller 30 according to a sixth embodiment of the present invention. FIG. 10A shows a state in which the cooling roller 30 is accommodated in the image forming apparatus, and FIG. 10B shows a state in which the cooling roller 30 is extracted from the image forming apparatus.

As shown in FIGS. 10A and 10B, the supporting part 30*a* supporting the rotating part 30*b* of the cooling roller 30 is connected to a supply pipe 44 that supplies the cooling liquid to the cooling roller 30 and a discharge pipe 45 that discharges the cooling liquid from the cooling roller 30. Similar to the above embodiments, the supply pipe 44 and the discharge pipe 45 are fluid paths that constitute the parts of the circulation paths 35 shown in FIG. 4. Specifically, in FIGS. 10A and 10B, the supply pipe 44 is a connecting member that connects the cooling roller 30 to the pump 31, and the discharge pipe 45 is a connecting member that connects the cooling roller 30 to the radiator 32. The supply pipe 44 and the discharge pipe 45 are configured to include plural cylindrical members connected so as to be movable in the extracting direction A (moving direction) of the cooling roller 30. The material of the cylindrical members is not particularly limited so long as it has rigidity required to operate the function of the cylindrical members, such as a metal material like aluminum and plastic.

As described above, according to the sixth embodiment, the supply pipe 44 and the discharge pipe 45 are composed of the plural cylindrical members connected so as to be movable in the extracting direction A. Therefore, when the cooling roller 30 is extracted, the cylindrical members move forward, so that the supply pipe 44 and the discharge pipe 45 expand following the cooling roller 30. Thus, the connection between the cooling roller 30 and the pump 31 and the like can be maintained even when the cooling roller 30 is extracted. On the other hand, when the cooling roller 30 is accommodated, the cylindrical members move backward, so that the supply pipe 44 and the discharge pipe 45 contract following the cooling roller 30. Therefore, the supply pipe 44 and the discharge pipe 45 can be compactly accommodated.

However, in the case of the sixth embodiment, the supply pipe 44 and the discharge pipe 45 are composed of the plural cylindrical members having different diameters connected to one another. Therefore, when the cooling pipe 30 is extracted and accommodated, it is expected that the fluid path cross-sectional areas of the supply pipe 44 and the discharge pipe 45 fluctuate and thus a pressure change occurs. As opposed to the sixth embodiment, in the case of the first and second embodiments in which the flexible tubes are spirally provided and the third through fifth embodiments in which the flexible tubes are capable of being wound, the fluid paths cross-sectional areas of the supply pipe 44 and the discharge pipe 45 do not fluctuate when the cooling pipe 30 is extracted and accommodated. Therefore, pressure changes in the fluid paths are reduced, so that a high-efficiency cooling system can be realized.

As described above, according to the embodiments of the present invention, the connection between the cooling roller 30 and the pump 31 and the like can be maintained even when the cooling roller 30 is accommodated or extracted. Therefore, the intrusion of foreign matter into the fluid paths can be prevented. Thus, the degradation of the cooling liquid and the possibility of failure in the pump 31 can be avoided. In addition, unlike conventional cooling devices, the cooling liquid remaining at the connection part (separation part) of the cooling pipe 30 never falls into the image forming apparatus main body when the cooling pipe 30 is separated. Therefore, image formation would not be adversely affected.

Moreover, according to the embodiments of the present invention, the cooling liquid can be supplied to the cooling roller 30 even when the sheet ejection unit 9 is extracted from the image forming apparatus main body 100. Therefore, the cooling roller 30 and its peripheral members can be continuously cooled. Thus, a maintenance operation and processing for addressing sheet jams can be performed while the temperature of the sheet ejection unit 9 provided near the fixing unit 8 is decreased, and thus the present invention is excellent in security. Further, with the employment of the configuration according to the embodiments of the present invention, the pump 31, the radiator 32, and the like can be provided in the image forming apparatus main body 100 without being integrated with the cooling roller 30. Therefore, the upsizing of the image forming apparatus main body 100 can be avoided.

The present invention is not limited to the specifically disclosed embodiments, and variations and modifications may be made without departing from the scope of the present invention. Unlike the above embodiments, the cooling unit is not limited to the cooling roller 30. For example, the cooling unit can be one configured to supply the cooling liquid to a guide plate that contacts the recording sheet P.

Meanwhile, from the viewpoint of downsizing, the image forming apparatus shown in FIG. 1 is arranged so as to achieve high density inside the apparatus and hide the fixing unit 8 under the intermediate transfer belt 10. Further, the intermediate transfer belt 10 is folded so as to cover the upper surface and right surface of the fixing unit 8. However, with the employment of this configuration, the fixing unit 8 comes close to the intermediate transfer belt 10, and the intermediate transfer belt 10 is thermally affected by the fixing unit 8 serving as a heat generation source. As a result, there is a likelihood of a trouble in images such as a color shift occurring. This trouble becomes remarkable when heat generated amount inside the apparatus increases as the high speed of the apparatus is realized. Moreover, in the case of an image forming apparatus having a double-sided printing function, a recording sheet heated by a fixing unit contacts an intermediate transfer belt again. Therefore, the temperature of the intermediate transfer belt further increases due to heat transmitted from the recording sheet, and conditions become worse. Further, if the heat of the intermediate transfer belt 10 is transmitted to the photosensitive bodies 2 and the development units 4, trouble such as the solidification of toner occurs more easily.

Therefore, in order to prevent the occurrence of the above problems, it is also possible to provide the cooling device 26 according the embodiments of the present invention in a process unit having a photosensitive body and a development unit, an intermediate transfer belt, a fixing unit, or the like. Thus, even when the process unit, the intermediate transfer belt, the fixing unit, or the like is extracted from an image forming apparatus main body to perform a maintenance operation and processing for addressing sheet jams, cooling liquid can be supplied to a cooling unit provided in the process unit, the intermediate transfer belt, the fixing unit, or the like. Therefore, a cooling operation can be performed continuously.

Further, the image forming apparatus having the cooling device 26 mounted is not limited to the one shown in FIG. 1. The cooling device 26 according to the embodiments of the present invention can be mounted on other copiers, printers, facsimile machines, or multi-function machines.

Further, according to the embodiments, the configuration of the present invention is applied to the cooling device 26 having the cooling part (cooling roller) 30 capable of moving when being accommodated and extracted. However, according to the embodiments of the present invention, positions to which the cooling part 30 is moved are not limited to the position when the cooling part 30 is accommodated and the position when the cooling part 30 is extracted. In other words, the configuration of the present invention can be applied to a cooling device having a cooling part capable of moving between a first position and a second position different from the first position with respect to the image forming apparatus main body; a cooling medium supply part provided so as not to move integrally with the cooling part; and a connecting member that connects the cooling part to the cooling medium supply part. Thus, the cooling part can be connected to the cooling medium supply part even when the cooling part is arranged at either the first position or the second position.

The present application is based on Japanese Priority Application No. 2009-198350 filed on Aug. 28, 2009, the entire contents of which are hereby incorporated herein by reference.

What is claimed is:

1. A cooling device comprising:

a cooling part that is movably provided between a first position within an image forming apparatus main body and a second position outside the image forming apparatus main body and cools a periphery thereof with a cooling medium to be supplied;

a cooling medium supply part that is provided in the image forming apparatus main body and cools and supplies the cooling medium to the cooling part; and a connecting member that connects the cooling part to the cooling medium supply part to circulate the cooling medium between the cooling part and the cooling medium supply part; wherein the connecting member includes a flexible member and is spirally provided with a moving direction of the cooling part as an axis center.

2. The cooling device according to claim 1, further comprising:

a guide member that is provided so as to extend in the moving direction and guides the connecting member.

3. The cooling device according to claim 1, wherein:

the connecting member includes a flexible member and is spirally disposed such that the cooling part is movable in a direction perpendicular to a sheet conveying direction of the image forming apparatus main body.

4. The cooling device according to claim 1, wherein:

wherein the diameter of the spiral is constant along the moving direction.

5. The cooling device according to claim 2, wherein:

the guide member is disposed along an inner portion of the connecting member which is spirally provided.

6. A cooling device comprising:

a cooling part that is movably provided between a first position and a second position different from the first position with respect to an image forming apparatus main body and cools a periphery thereof with a cooling medium to be supplied;

a cooling medium supply part that is provided in the image forming apparatus main body and cools and supplies the cooling medium to the cooling part;

a connecting member that connects the cooling part to the cooling medium supply part to circulate the cooling medium between the cooling part and the cooling medium supply part, the connecting member including a flexible member, and the connecting member for carrying the cooling medium therein; and a winding member capable of winding and unwinding the connecting member, wherein the cooling part is movably provided between the first position which is within the image forming apparatus main body and the second position which is outside the image forming apparatus main body.

7. A cooling device comprising:

a cooling part that is movably provided between a first position and a second position different from the first position with respect to an image forming apparatus main body and cools a periphery thereof with a cooling medium to be supplied;

a cooling medium supply part that is provided in the image forming apparatus main body and cools and supplies the cooling medium to the cooling part; and a connecting member that connects the cooling part to the cooling medium supply part to circulate the cooling medium between the cooling part and the cooling medium supply part, wherein the connecting member includes plural telescoping cylindrical members connected to extend in a direction towards the cooling part and retract in a direction away from the cooling part, wherein the cooling part is movably provided between the first position which is within the image forming apparatus main body and the second position which is outside the image forming apparatus main body.

* * * * *